US005889365A

United States Patent [19]

Tanabe

[11] Patent Number: 5,889,365

[45] Date of Patent: Mar. 30, 1999

[54] PLASMA DISPLAY PANEL

[75] Inventor: Hisao Tanabe, Tokyo, Japan

[73] Assignee: Dai Nippon Printing Co., Ltd., Japan

[21] Appl. No.: 738,592

[22] Filed: Oct. 29, 1996

[30] Foreign Application Priority Data

Oct. 30, 1995 [JP] Japan ..... 7-281485

[51] Int. Cl.[6] ..... H01J 17/49

[52] U.S. Cl. ..... 313/582; 313/583; 313/584; 313/585

[58] Field of Search ..... 313/484, 485, 313/582–85, 586–87, 590; 340/769; 315/169.4, 169.1, 169.3, 167

[56] References Cited

U.S. PATENT DOCUMENTS 4,147,960 4/1979 Andoh et al. ..... 340/769
5,099,173 3/1992 Kim et al. ..... 313/584 X
5,124,615 6/1992 Kim ..... 313/584 X
5,747,939 5/1998 Kim et al. ..... 313/586 X

*Primary Examiner*—Sandra O'Shea
*Assistant Examiner*—Mack Haynes
*Attorney, Agent, or Firm*—Parkhurst & Wendel, L.L.P.

[57] ABSTRACT

A plasma display (PDP) has a front plate, a rear plate, barrier ribs formed in a space between the front and the rear plate so as to form discharge cells in the space, buses extended along the barrier ribs, and discharge terminals disposed in the discharge cells, respectively. The buses and the discharge terminals are electrically connected by straight resistors. Connecting parts are extended from the buses along the alternate barrier ribs so as to connect the buses and the resistors.

13 Claims, 6 Drawing Sheets

PLASMA DISPLAY PANEL

BACKGROUND OF THE INVENTION

1. Field of the Invention

The present invention relates to a plasma display panel (hereinafter abbreviated to "PDP") and, more specifically, to a DC PDP provided with electrodes and resistors of novel structure.

2. Description of the Related Art

There have been proposed various types of gas discharge display panels and R & D efforts have been made for the development of large gas discharge display panels, and the enhancement of efficiency and definition. A so-called DC PDP is representative of those known gas discharge display panels. The DC PDP has two transparent insulating substrates, a group of cathodes and a group of anodes formed on the two substrates, respectively, and barrier ribs arranged in a grid between the two substrates to form discharge cells having discharge terminals. Gas discharges are induced in the discharge cells to emit light. In the DC PDP, suppression of sputtering of the cathodes as the result of impact by ions of the discharge gas is very important to extend the life of the dc PDP. A previously proposed method of suppressing the sputtering of the cathodes increases the pressure of a discharge gas confined in a PDP to reduce the kinetic energy of positive ions of the discharge gas. However, abnormal discharges due to the high pressure of the discharge gas must be avoided when the pressure of the discharge gas is increased. A previously method of avoiding abnormal discharges combines resistors of 50 to 1500 k( with the discharge cells, respectively, for current control.

The conventional DC PDP is provided with discrete resistors respectively for the discharge cells. A structure of such a configuration is unsuitable for miniaturization and difficult to fabricate. In addition, the different resistors have different resistances that cause difference in discharge current between the discharge cells, which entails difference in the intensity of light between the discharge cells. Such difference in the intensity of light forms an irregular luminance distribution on the screen.

In order to prevent the above drawback, the inventors of this application have developed such a structure that the resistors extend continuously through the plurality of discharge cells to connect the discharge terminals through connecting parts. In this structure, however, the discharge terminals are affected by the adjacent discharge terminals, and therefore they cause also the difference in the intensity of light between the discharge cells.

SUMMARY OF THE INVENTION

The present invention has been made in view of the foregoing problem and it is therefore an object of the present invention to provide a PDP comprising a plurality of discharge cells having discharge terminals and resistors, each discharge terminal being not affected by the adjacent discharge terminals and the resistors being easily produced and designed.

According to the present invention, there is provided a plasma display panel comprising: a front plate; a rear plate disposed substantially in parallel to the front plate; barrier ribs arranged in the shape of a grid in a space between the front plate and the rear plate to form discharge cells in the space; a cathode group provided on one of the front plate and the rear plate; and an anode group provided on the other of the rear plate and the front plate; wherein at least one of the cathode group and the anode group includes a plurality of parallel buses having connecting parts, discharge terminals disposed in the discharge cells, and resistors respectively interconnecting the connecting parts and the discharge terminals, and each of the connecting parts is formed for each of the alternate discharge cells.

According to the present invention, as each of the connecting parts is formed for each of the alternate discharge cells, even if the resistors continuously extend through the plurality of discharge cells, the length of the resistors between the discharge terminals and the connecting parts corresponding to the discharge terminals is shorter (for example, one third) than the length of the resistors between the discharge terminals and the connecting parts corresponding to the adjacent discharge terminals. Thus, each discharge terminals are not affected by the adjacent discharge terminals, and therefore the difference in the intensity of light between the discharge cells cannot occur. In addition, as the connecting parts is formed according to the alternate discharge cells, the structure of the PDP is suitable for miniaturization and easily produced.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1A:
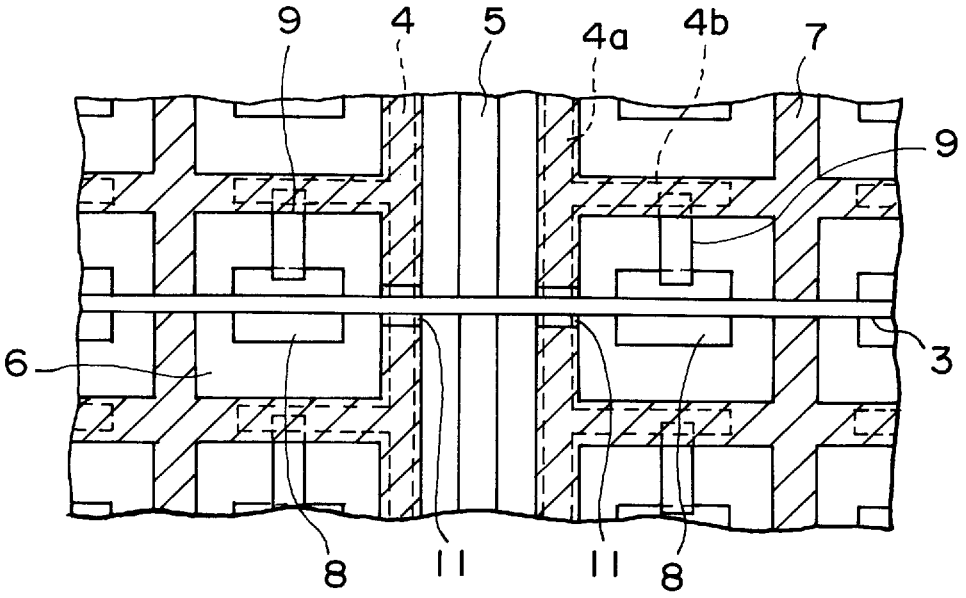
FIG. 1A is a plan view of a PDP in accordance with the present invention as viewed from the side of a front plate, in which the front plate is removed to facilitate understanding the internal structure.
Figure 1B:
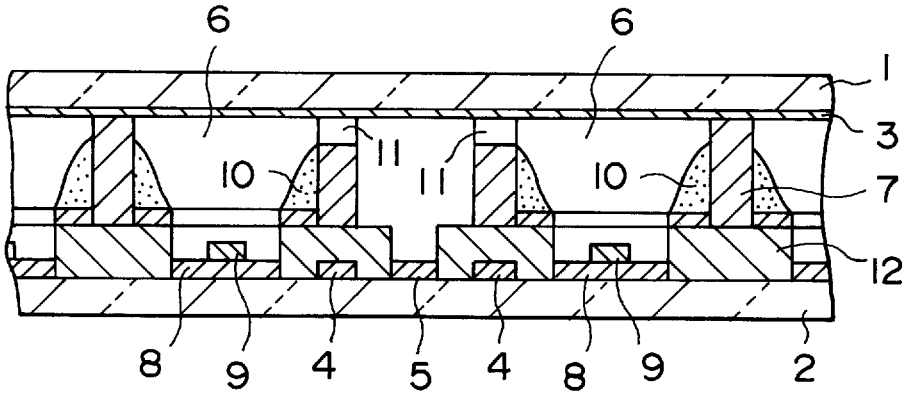
FIG. 1B is a cross-sectional view of the PDP of FIG. 1A.

The basic principle of a dc PDP will be explained with reference to FIGS. 1A and 1B prior to the description of a preferred embodiments of the present invention. Referring to FIGS. 1A and 1B showing a PDP in accordance with the present invention in a plan view and a cross-sectional view, respectively, the PDP has a front plate 1 and a rear plate, a cathode group including cathodes 3 are formed on the front plate 1, and an anode group including buses 4 and an auxiliary anode 5 is formed on the rear plate 2. The cathodes 3 are perpendicular to the anode buses 4 and the auxiliary anode 5.

Barrier ribs 7 are formed in the shape of a grid between the front plate 1 and the rear plate 2 to form discharge cells 6. An anode terminal 8 is disposed in each of the discharge cells 6, and each of the cathodes 3 extends through middle portions of the discharge cells 6. The anode terminals 8 are electrically connected to the anode buses 4 by resistors 9, respectively. When a voltage is applied across the cathodes 3 and the anode bus 4, a current flows through the resistor 9 to the anode terminal 8 to produce a discharge in the corresponding discharge cell 6. Ultraviolet rays produced by the discharge strike R, G and B fluorescent coatings 10 of fluorescent materials formed on inner side surfaces of the barrier ribs 7 and, consequently, the R, G and B fluorescent coatings 10 emit visible light. The visible light thus emitted by the R, G and B fluorescent coatings 10 travels outside through the front plate 1 to display full-color images. The auxiliary anode 5 supplies priming particles that initiate discharges through priming slits 11 to the discharge cells 6.

The barrier ribs 7 are formed on a white insulating layer 12 overlying the rear plate 2. The white insulating layer 12 enhances the clearness of color images displayed on the PDP and prevents discharge in regions other than those corresponding to the anode terminals 8. Since the current is controlled by the respective resistors 9 of the discharge cells 6 in this PDP, current efficiency is improved, the reduction of luminance due to damage in the cathodes 3 caused by sputtering can be prevented, and the life of the PDP can be extended.

A PDP in a preferred embodiment according to the present invention will be described hereinafter with reference to FIGS. 2A and 2B.

Figure 2A:
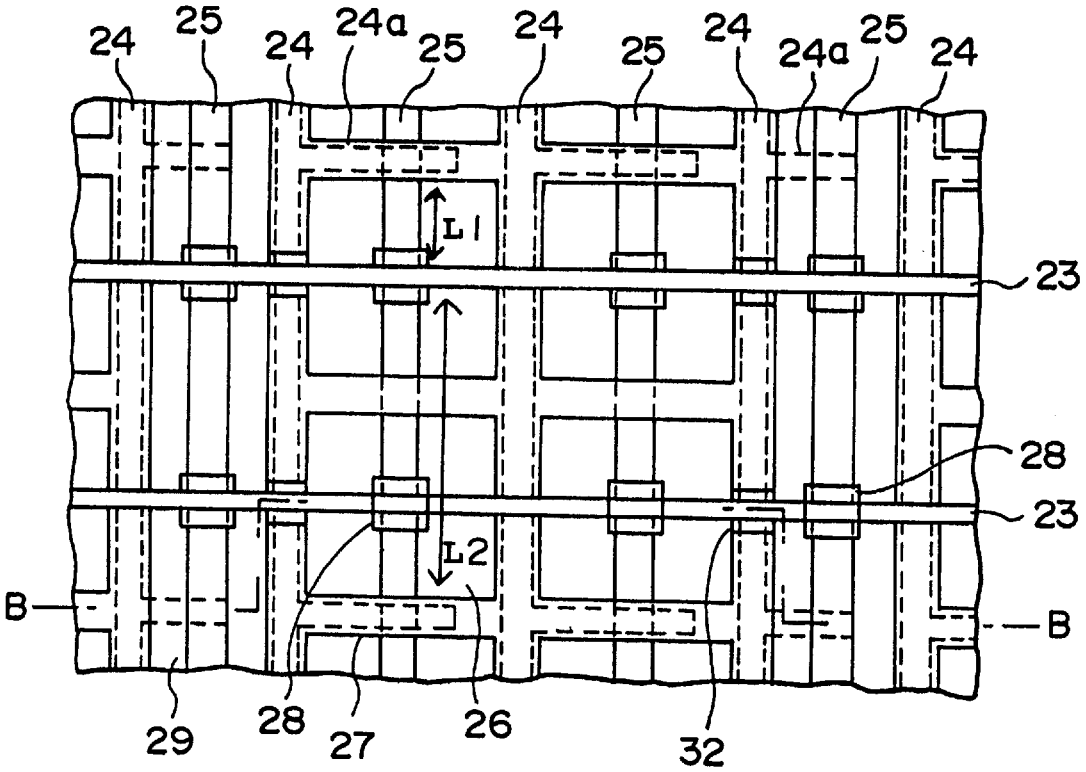
FIG. 2A is a plan view of a PDP in a preferred embodiment according to the present invention as viewed from the side of a front plate, in which the front plate is removed to facilitate understanding the internal structure.
Figure 2B:
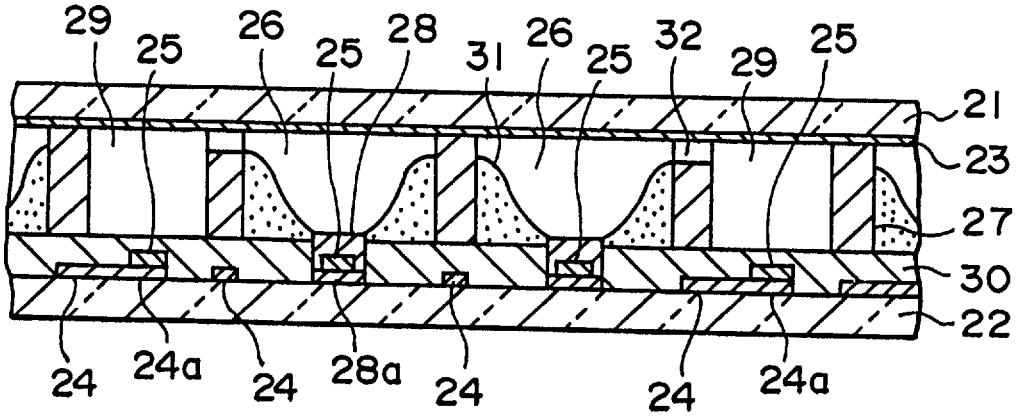
FIG. 2B is a sectional view taken on line B—B in FIG. 2A.

Referring to FIGS. 2A and 2B showing the PDP embodying the present invention in a plan view and a cross-sectional view, respectively, The PDP has a front plate 21, a rear plate 22, a cathode group including straight cathodes 23 formed on the front plate 21, a plurality of parallel anode buses 24, formed on the rear plate 22, and straight resistors 25 formed in parallel to the anode buses 24 on the rear plate 22. The anode buses 24 have anode branches (connecting parts) 24*a* connected to the resistors 25, respectively. These anode buses 24 having the anode branches 24*a,* and the resistors 25 constitute an anode group.

Barrier ribs 27 are formed in the shape of a grid between the front plate 21 and the rear plate 22 to form a plurality of discharge cells 26. An anode terminal 28 is formed in a central portion of each discharge cell 26 so as to overlie a portion of the resistor 25.

The anode buses 24 are formed parallel to each other so as to extend along each barrier ribs 27, each of the strip-shaped resistors 25 extends through the plurality of discharge cells 26, and each of the resistors 25 extends through the middle portions of the plurality of discharge cells 26.

The barrier ribs 27 form one auxiliary discharge cell 29 every two columns of the discharge cells 26 adjacent to the discharge cells 26. Anode terminals 28 are formed in the auxiliary discharge cell 29 so as to overlie the resistor 25 at positions corresponding to the anode terminals 28 of the discharge cells 26.

The anode branches 24*a* extend perpendicularly to the corresponding anode buses 24 in portions corresponding to the discharge cells 26 so as to extend along every alternate barrier rib 27. In portions corresponding to the auxiliary discharge cells 29, the anode branches 24*a* extend from the anode buses 24 on lines on which the anode branches 24*a* corresponding to the discharge cells 26.

Thus, the anode branches 24*a* of each anode bus 24 are formed at corresponding positions and hence the anode branches 24*a* of the anode buses 24 are arranged on straight horizontal lines as viewed in FIG. 2A.

According to the present invention, as each of the anode branches 24 is formed along the alternate barrier ribs 27, the length L1 of the resistors 25 between the discharge terminals 28 and the anode branches 24*a* corresponding to the discharge terminals 28 is shorter (for example, one third) than the length L2 of the resistors 25 between the discharge terminals 28 and the anode branches 24*a* corresponding to the adjacent discharge terminals 28. Thus, each discharge terminals 28 are not affected by the adjacent discharge terminals 28 and therefore the difference in the intensity of light between the discharge cells 26 cannot occur. In addition, as the anode branches 24*a* is formed according to the alternate discharge cells 26, the structure of the PDP is suitable for miniaturization and easily produced.

The barrier ribs 27 are formed on an insulating layer 30 formed on the rear plate 22, fluorescent coatings 31 of fluorescent materials are formed on inner side surfaces of the barrier ribs 27, and the priming slits 32 are formed in the upper ends of the barrier ribs 27.

When necessary, lower anode terminals 28*a* may be formed on the rear plate 22. When a film formed over the surfaces of the resistors 25 during the formation of the resistors 25 obstructs satisfactory contact between the anode terminals 28 and the resistors 25, the lower anode terminals 28*a* connects the anode terminals 28 to the resistors 25.

Figure 3A:
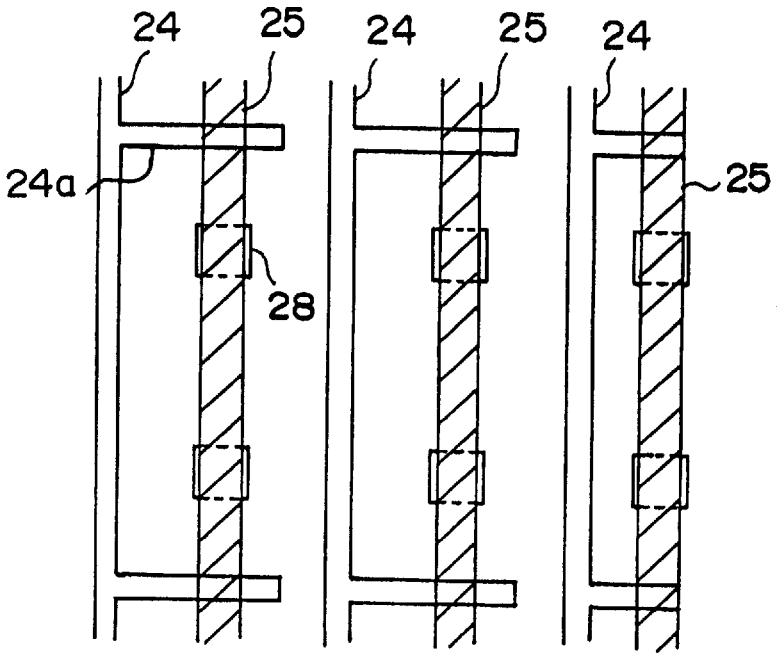
FIG. 3A is a view showing a layout of electrodes and resistors in the PDP shown in FIGS. 2A and 2B.
Figure 3B:
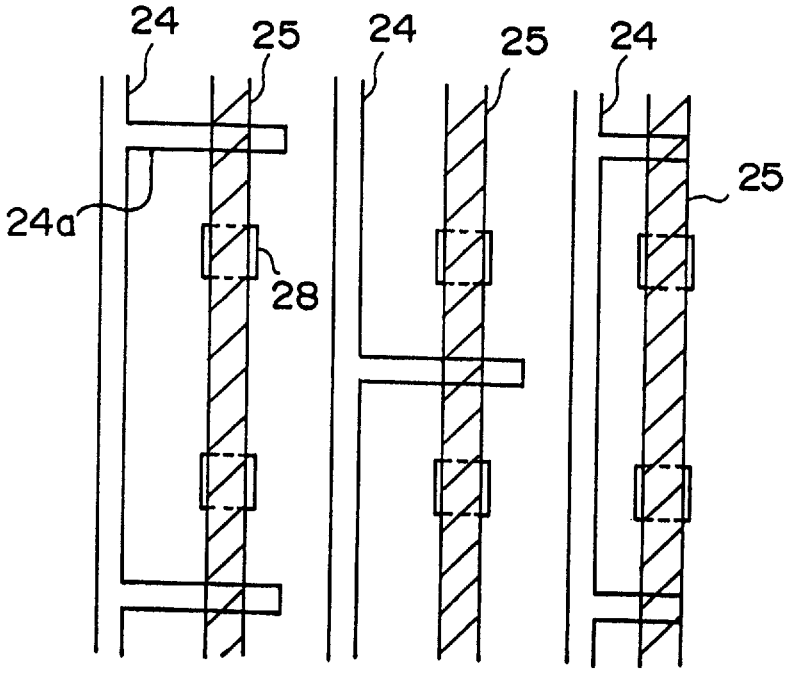
FIG. 3B is a view showing a layout of electrodes and resistors in the PDP shown in FIGS. 2A and 2B.

The anode buses 24, the resistors 25 and the anode terminals 28 of the PDP shown in FIGS. 2A and 2B are arranged as shown in FIG. 3A. The anode branches 24*a* of the adjacent anode buses 24 may be formed in a zigzag arrangement as shown in FIG. 3B.

The operations of the PDP in this embodiment are substantially the same as those of the PDP shown in FIGS. 1A and 1B. A method of fabricating the PDP will be described hereinafter. Although screen printing is the simplest method of forming the anode buses 24 and the resistors 25, the resistances of the resistors 25 are liable to scatter in a wide range due to in accurate dimensions of the resistors 25 attributable to an inaccurate pattern forming method. Therefore, the patterns of the anode buses 24 and the resistors 25 are formed by a photolithographic process to prevent the scatter of the resistances of the resistors 25 in a wide range.

Figure 4:
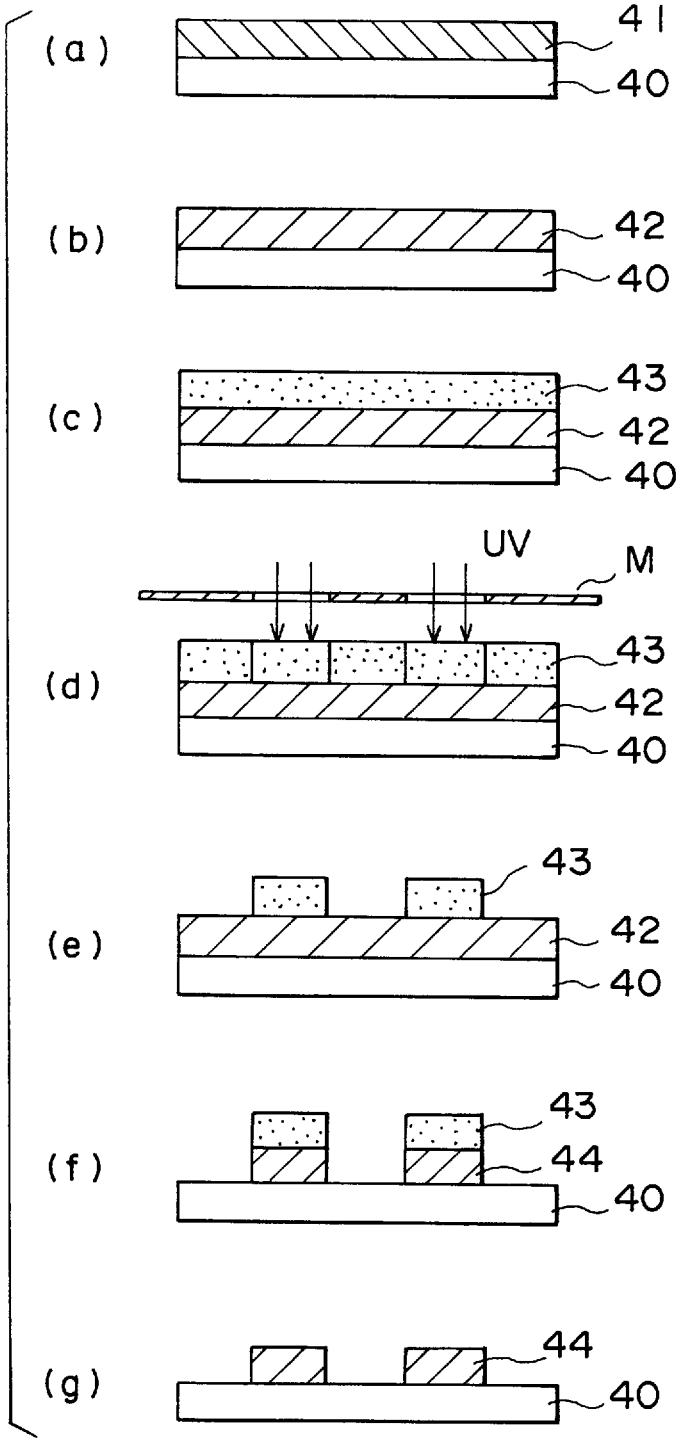
FIG. 4 is a typical sectional view of assistance in explaining steps of a method of forming electrodes of the PDP shown in FIGS. 2A and 2B.

FIGS. 4(*a*) to 4(*g*) show a workpiece in different phases of an anode bus forming process for forming the anode buses 24 and the anode branches 24*a* on a base plate 40, which serves as the rear plate 22. The base plate 40 is a flat or curved plate of any chemically stable material, such as a glass plate or a resin plate. The base plate 40 for the rear plate 22 of this embodiment is a glass plate. The base plate 40 is washed and annealed before subjecting the same to the anode bus forming process. An undercoat 41 may be formed over the surface of the glass base plate 40 as shown in FIG. 4(*a*) to furnish a good base for screen printing. The undercoat 41 is formed by applying a glass paste to the surface of the base plate 40 in a film by a screen printing process, drying the film and baking the dried film.

A conductive paste is applied to the surface of the base plate 40 in a thick film by a screen printing process, the film is dried and baked to form a conductive film 42 as shown in FIG. 4(*b*). In FIGS. 4(*b*) to 4(*g*), the undercoat 41 is omitted. The conductive film 42 is patterned by an etching process to form the anode buses 24. The conductive paste may be of any conductive material capable of forming a paste and of processed by chemical etching and containing a metal, such as Au, Ag, Pd, Al, Ni, Cu or such, one of alloys of those metals, or a conductive oxide, such as ITO or such. A conductive material containing Au or Ag is preferable.

The conductive film 42 may be a thin film formed by an evaporation process or a sputtering process instead of the thick printed film. When the conductive film 42 is to be formed by an evaporation process or a sputtering process, there is a wide choice of conductive materials including pellets for evaporation or targets for sputtering available on the market. Preferable conductive materials are Cr, Al, Ni and Cu.

Subsequently, a liquid photosensitive resin is applied to the surface of the conductive film 42 in a film and the film is dried to form a photosensitive film 43 as shown in FIG. 4(*c*). The liquid photosensitive resin may be applied to the surface of the conductive film 42 by any suitable coating method of coating a surface with a liquid coating material, such as a spin coating method, a roll coating method, a reverse coating method, a spraying method or a tipping method. A resist film may be used instead of the photosensitive film 43. A resist film may directly be bonded to the surface of the conductive film 42 by a laminator.

Subsequently, the photosensitive film 43 is exposed through a mask M carrying a pattern of the anode buses 24 having the anode branches 24*a* to light as shown in FIG. 4(*d*). When the photosensitive film 43 is a resist film, a latent image of the pattern of the mask M can be formed on the photosensitive film 43 in a satisfactory resolution when the hardening of exposed portions of the photosensitive film 43 is promoted by heating the photosensitive film 43 at 70° to 90° C. for about 5 to about 15 min. Then, the image of the pattern formed on the photosensitive film 43 is developed to form a resist pattern as shown in FIG. 4(*e*). The exposed portions are chemically dissolved by a developer when the photosensitive film 43 is of a positive type, or portions other than the exposed portion are chemically dissolved by a developer when the photosensitive film 43 is of a negative type to develop the resist pattern. After the resist pattern has been developed, the remaining portions of the photosensitive film 43 is hardened by a heat treatment process. The heat treatment process enhances adhesion between the conductive film 42 and the photosensitive film 43 to prevent etching defects which may otherwise arise during a subsequent etching process. The heat treatment process is not always necessary for photosensitive films of some photosensitive resins.

Then, the conductive film 42 is subjected to a chemical etching process using the patterned photosensitive film 43 as a mask to form electrodes 44, i.e., the anode buses 24 having the anode branches 24*a,* as shown in FIG. 4(*f*), and then the photosensitive film 43 is removed as shown in FIG. 4(*g*). The base plate carrying the electrodes 44 is washed and dried.

When the PDP is provided with the lower anodes 28*a* shown in FIG. 2(*b*), the lower anodes 28*a* may be formed simultaneously with the electrodes 44, i.e., the anode buses 24 having the anode branches 24*a,* by using a mask M additionally provided with a pattern of the lower anodes 28*a.*

Figure 5:
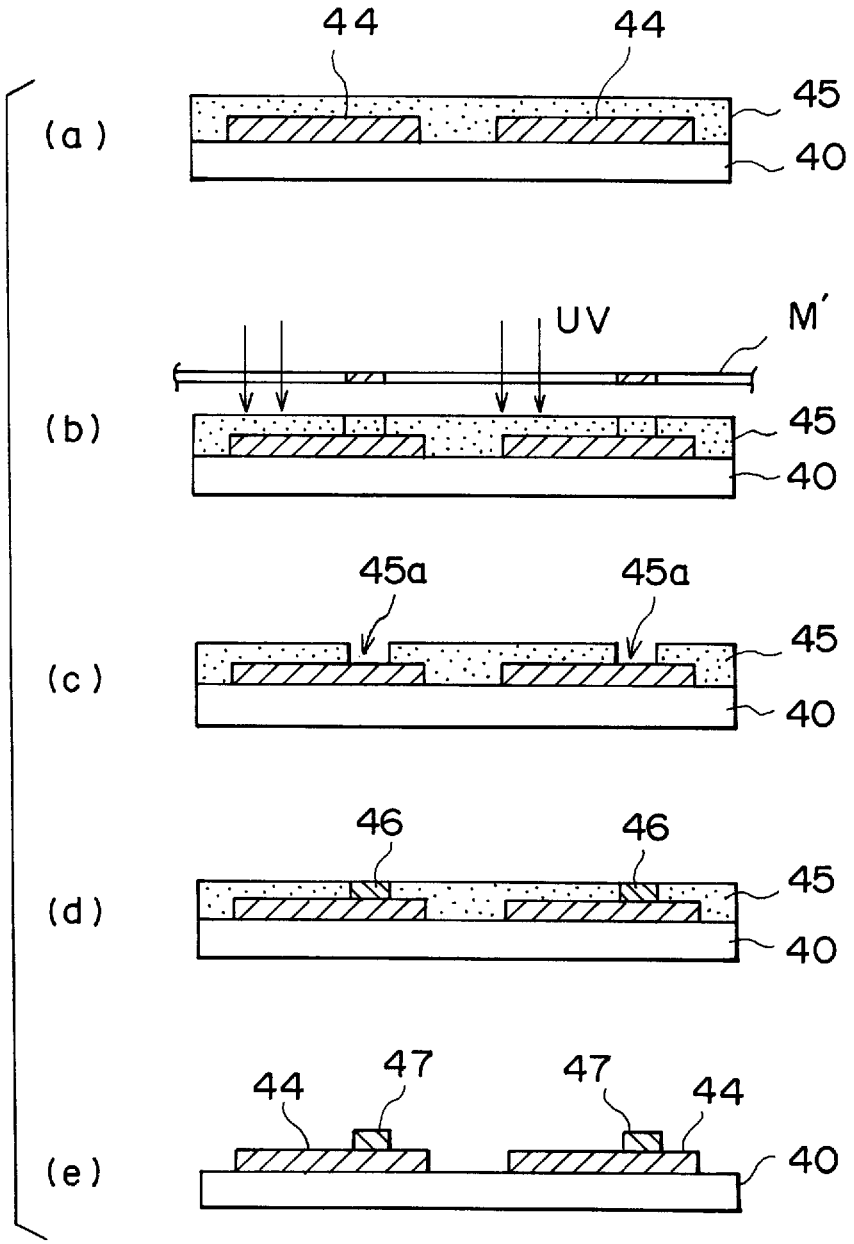
FIG. 5 is a typical sectional view of assistance in explaining steps of a method of forming resistors to be carried out subsequent to the method of forming electrodes.

The resistors 25 are formed after thus forming the electrodes 44 by a resistor forming process illustrated in FIGS. 5(*a*) to 5(*e*). The resistor forming process will be described hereinafter.

A photosensitive film 45 of a photosensitive resin is formed over the surface of the base plate 40 provided with the electrodes 44, i.e., the anodes 24 having the anode branches 24*a,* so as to cover the electrodes 44 as shown in FIG. 5(*a*). The photosensitive film 45 may be formed either by applying a liquid photosensitive resin to the surface of the base plate 40 in a film and processing the film or by bonding a resist film to the base plate 40. The liquid photosensitive resin may be applied to the surface of the base plate 40 by any one of the coating methods mentioned above. Then, the photosensitive film 45 is exposed to light through a mask M' provided with a pattern of the resistors 25 as shown in FIG. 5(*b*) to form a latent image of the pattern of the resistors 25 on the photosensitive film 45. The latent image formed on the photosensitive film 45 is developed to form a resist pattern having openings 45*a* corresponding to the resistors 45 as shown in FIG. 5(*c*).

Subsequently, the openings 45*a* are filled up with a resistive material 46 for forming the resistors 45 as shown in FIG. 5(*d*). The $RuO_2$ paste filling up the openings 45*a* shrinks when dried. Therefore it is desirable to repeat the step of filling up the openings 45*a* at last twice when the $RuO_2$ paste is used as the resistive material 46. After the openings 45*a* have been filled up with the resistive material 46, the photosensitive film 45 is removed from the base plate 40 as shown in FIG. 5(*e*). When the RuO2 paste is used, the resistive paste 46 is baked after removing the photosensitive film 45 to complete resistors 47, i.e., the resistors 25.

Subsequently, the anode terminals 28 are formed after forming the resistors 25 by a process similar to that for forming the resistors 47. More concretely, a photosensitive film 45 (FIG. 5(*a*)) is formed over the surface of the base plate 40 carrying the electrodes 44 and the resistors 47 so as to cover the electrodes 44 and the resistors 47. The photosensitive film 45 is exposed to light through a mask provided with a pattern of the anode terminals 28 to form an image of the pattern on the photosensitive film 45, the image is developed to form openings corresponding to the anode terminals 28 in the photosensitive film 45, the openings are filled up with a conductive material, the photosensitive film 45 is removed and then, the conductive material is baked to complete the anode terminals 28 shown in FIGS. 2A and 2B. The conductive material for forming the anode terminal 28 may be any suitable conductive material capable of filling up the openings in the photosensitive film 45. A conductive material containing Au or Ni is preferable.

A PDP fabricating process subsequent to the formation of the anode buses 24 having the anode branches 24*a,* the resistors 25 and the anode terminals 28 by the foregoing processes or a method employing a screen printing process is the same as the conventional PDP fabricating process. Therefore, only a brief description of the PDP fabricating process will be given. The insulating layer 30 and the fluorescent coatings 31 are formed by a screen printing process, and the barrier ribs 27 are formed by a screen printing process or a sandblasting process. The cathodes 23 are formed on a base plate, which serves as the front plate 21, by a screen printing process. The front plates 21 and the rear plate 22 are joined together to seal a gas , such as Ne—Xe gas or He—Xe gas, in a space between the front plate 21 and the rear plate 22 to complete the PDP.

Figure 6:
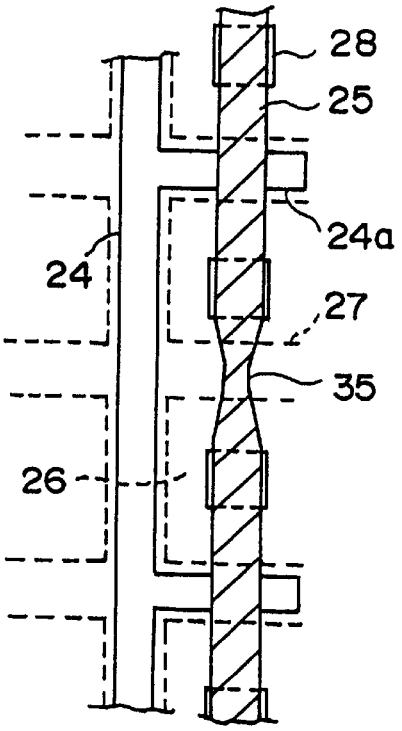
FIG. 6 is a plan view of a modification of the PDP shown in FIGS. 2A and 2B.

A modification of the PDP of the present invention will be described with reference to FIG. 6. A PDP in a modification of the dc PDP shown in FIGS. 2A and 2B is substantially the same in configuration as the dc PDP shown in FIGS. 2A and 2B, except that the PDP shown in FIG. 6 is provided with resistors 25 having necks 35 therein. As shown in FIG. 6, barrier ribs 27 are formed in the shape of a grid, anode buses 24 are extended along the barrier ribs 27, and anode branches 24*a* are formed perpendicularly to the anode buses 24 along the alternate barrier ribs 27.

Resistors 25 is formed in the shape of a strip so as to extend through middle portions of a plurality of discharge cells 26 defined by the barrier ribs. Anode terminals 28 are disposed in the central portions of the discharge cells 26, respectively.

The necks 35 are formed in portions of the resistors 25 near the barrier ribs 27 along which the anode branches 24*a* are not formed. Consequently, a current flows to the anode terminal 28 of each discharge cell 26 through the anode branch 24*a* nearest to the same anode terminal 28 and thereby electrical interference caused by the adjacent discharge cells 26 with each discharge cell can be suppressed to the least extent.

A PDP in another modification of the dc PDP of FIGS. 2A and 2B will be described with reference to FIGS. 7 and 8. This modification is substantially the same in configuration as the dc PDP of FIGS. 2A and 2B, except that resistors 25 are formed over anode buses 24.

Figure 7:
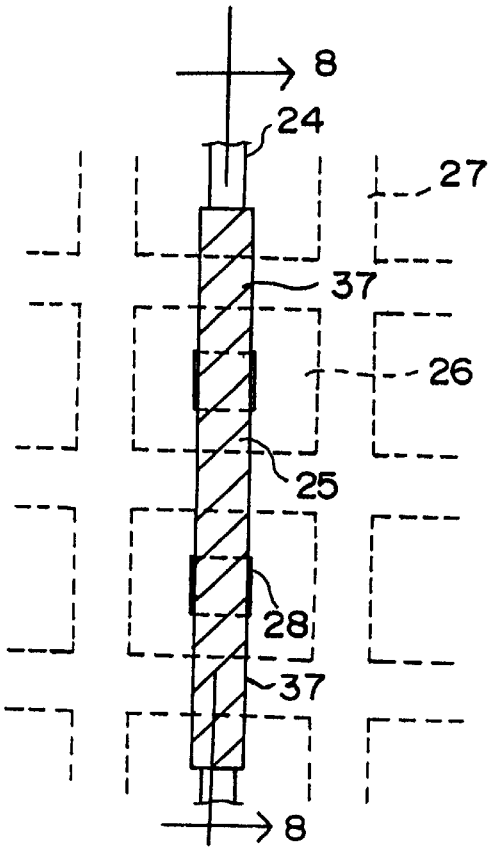
FIG. 7 is a plan view of another modification of the PDP shown in FIGS. 2A and 2B.
Figure 8:
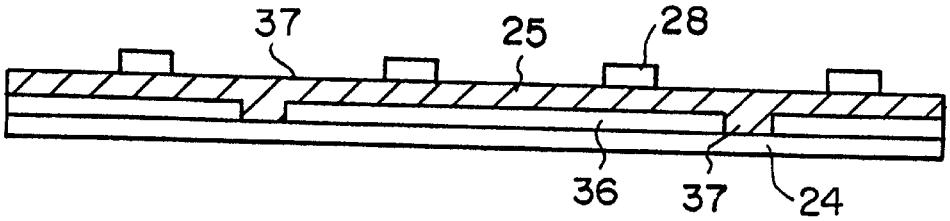
FIG. 8 is a sectional view taken along line 8—8 of FIG. 7.

Referring to FIGS. 7 and 8, barrier ribs 27 are formed in the shape of a grid to form a plurality of discharge cells 26. The anode buses 24 are extended through the plurality of discharge cells 26, and the resistors 25 are formed on an insulating layer 36 overlying the anode buses 24. The anode buses 24 and the resistors 25 extend through the middle portions of the discharge cells 26, and the anode buses 24 and the resistors 25 are interconnected by connecting parts or sections 37 formed on the alternate barrier ribs 27.

The formation of the resistors 25 over the anode buses 24 facilitates the miniaturization of the PDP.

The resistors 25 shown in FIG. 7 may be provided with necks like the necks 35 shown in FIG. 6 in portions thereof near the barrier ribs 27 not provided with the connecting parts 37.

In FIG. 7, the connecting parts 37 can be formed at positions corresponding to each other with respect to the adjacent buses 24 or in a zigzag arrangement with respect to the adjacent buses 24 (refer to FIGS. 3A and 3B).

Although the resistors 25 are disposed on the side of the anode group in this embodiment, the resistors 25 may be disposed on the side of the cathode group. Therefore, the term, anode group used in the foregoing description may be replaced with the term, cathode group. It is also possible to dispose the resistors both on the side of the anode group and the side of the cathode group.

The present invention is not limited in its practical application only to the PDP of the structure shown in FIGS. 2A and 2B. For instance, the present invention is applicable also to a display panel not employing any fluorescent coatings for light emission and employing a Ne-base gas as a discharge gas to emit light of a luminous glow discharge outside.

What is claimed is:

1. A plasma display panel comprising:

a front plate;

a rear plate disposed substantially in parallel to the front plate;

barrier ribs arranged in the shape of a grid in a space between the front plate and the rear plate to form discharge cells arranged in first and second directions in the space;

a cathode group provided on one of the front plate and the rear plate; and an anode group provided on the other of the rear plate and the front plate;

wherein at least one of the cathode group and the anode group includes a plurality of parallel buses having connecting parts, discharge terminals disposed in the discharge cells, and resistors respectively interconnecting the connecting parts and the discharge terminals, and one said connecting part is formed for each alternate discharge cell in one of the first and second directions.

2. The plasma display panel according to claim 1, wherein the buses extend along the barrier ribs, and the resistors extend in parallel to the buses.

3. The plasma display panel according to claim 2, wherein the buses are provided along the adjacent barrier ribs.

4. The plasma display panel according to claim 2, wherein the connecting parts are extended perpendicularly to the buses along the alternate barrier ribs.

5. The plasma display panel according to claim 4, wherein the resistors have a shape of a strip, and necks are formed in portions of the resistors near the barrier ribs not provided with the connecting parts.

6. The plasma display panel according to claim 4, wherein the connecting parts are formed at positions corresponding to each other with respect to the adjacent buses.

7. The plasma display panel according to claim 4, wherein the connecting parts are formed in a zigzag arrangement with respect to the adjacent buses.

8. The plasma display panel according to claim 1, wherein the resistors are extended over the buses on an insulating layer overlying the buses, and the resistors and the buses are connected by connecting sections.

9. The plasma display panel according to claim 8, wherein:

the barrier ribs extend in the first and second directions to form the grid; and the connecting sections are formed on the alternate barrier ribs in one of the first and second directions of the grid.

10. The plasma display panel according to claim 9, wherein the resistors are formed in the shape of a strip, and necks are formed in portions of the resistors near the barrier ribs not provided with the connecting sections.

11. The plasma display panel according to claim 8, wherein the connecting sections are formed at corresponding positions with respect to the adjacent buses.

12. The plasma display panel according to claim 8, wherein the connecting sections are formed in a zigzag arrangement with respect to the adjacent buses.

13. The plasma display panel according to claim 1, wherein the discharge cells arranged in the first and second directions form columns and rows, respectively.

* * * * *